US008950477B2

(12) United States Patent
Vagapov et al.

(10) Patent No.: US 8,950,477 B2
(45) Date of Patent: Feb. 10, 2015

(54) HYDRAULIC JAR

(75) Inventors: Yunir Gafurovich Vagapov, Ishimbaj (RU); Gniyatulla Garifullovich Ishbaev, Ufa (RU); Samat Yunirovich Vagapov, Ufa (RU)

(73) Assignee: Scientific and production enterprise Limited liability company BURINTEKH (BURINTEKH ltd) (RU)

( * ) Notice: Subject to any disclaimer, the term of this patent is extended or adjusted under 35 U.S.C. 154(b) by 462 days.

(21) Appl. No.: 13/337,188

(22) Filed: Dec. 26, 2011

(65) Prior Publication Data

US 2012/0090843 A1 Apr. 19, 2012

(51) Int. Cl.
*E21B 31/00* (2006.01)
*E21B 31/113* (2006.01)

(52) U.S. Cl.
CPC ..... *E21B 31/1135* (2013.01)
USPC ..... 166/178; 166/301.11; 166/311; 166/99

(58) Field of Classification Search
CPC ..... E21B 31/113; E21B 31/1135
USPC ..... 166/301, 178, 311, 99
See application file for complete search history.

(56) References Cited

U.S. PATENT DOCUMENTS

2007/0074909 A1 4/2007 Chancey

FOREIGN PATENT DOCUMENTS

| | | |
|---|---|---|
| RU | 2230880 | 1/2004 |
| RU | 2272122 | 3/2006 |
| RU | 2291275 | 8/2007 |

*Primary Examiner* — Yong-Suk (Philip) Ro

(57) ABSTRACT

The present invention relates to hydraulic jars which include a jar body; a spindle axially movable within the jar body and coupled to the jar body by means of a helical splined coupling; the spindle being connectable to a pipe string and the stuck object; a cylinder concentrically placed within the jar body with a radial gap, and having chambers for filling with a work fluid, the chambers being separated by a piston and fluidly connected by a channel, wherein the channel is provided by a back valve. The piston is axially movable within the cylinder, and is connectable to the spindle by means of a tractive rod, and to the body by means of a compensative rod. The piston is further provided with elastic split compression rings having initial gaps equal or close to zero.

8 Claims, 2 Drawing Sheets

HYDRAULIC JAR

CROSS-REFERENCE TO RELATED APPLICATION

This Application claims the benefits of the International Application PCT/RU2010/000350 filed on Jun. 23, 2010, claiming priority from RU 2009125092 of Jun. 29, 2009. The content of these applications is hereby incorporated by reference in its entirety.

TECHNICAL FIELD

The invention relates to oil and gas industry and can be used in well drilling as a part of a Bottom Hole Assembly (BHA) to releasing stuck tools or equipment by applying axial and torque impacts.

BACKGROUND OF THE INVENTION

Hydraulic jars are described in the prior art. For example, Gore Kemp, in Oilwell Fishing Operations: Tools and Techniques. Gulf Publishing Company/Book Division/Houston, London, Paris, Tokyo), discloses a jar, which contains a cylinder connectable to a stuck object and filled with fluid. The cylinder encloses a piston, which is connected via a rod to a work string of pipes (a pipe string), wherein the rod inlet in the cylinder is sealed with a packer. To make a stroke by using the tension of the pipe string, the piston is loaded to create pressure on the working fluid in the cylinder above the piston. Due to leakage of working fluid through the pair "cylinder-piston", the piston moves upwards and reaches in the cylinder an area with expanded bored diameter. As a result, the pressure in the said area of piston rapidly drops that causes the stretched (deformed) pipe string to contract quickly under elastic forces, whereupon the piston strokes the top part of the cylinder.

The disadvantage of the above described jar is low efficiency, due to the fact that the pair "piston-cylinder" is made with a significant gap, otherwise return of the piston back to original position becomes difficult. As a result, the above described jars can operate only under relatively low pressure drops on piston during upstroke that limits deformation of pipe string and, hence, impact force.

A hydraulic jar [RU patent 2272122 C2, Int.Cl. E21B 31/113, publ. Mar. 20, 2006], which includes a cylinder, a piston connected to a tractive rod and a compensative rod, which are sealed with packers arranged at butt ends of cylinder, can be chosen as the closest prior art. Cylinder cavities separated by the piston are in a fluid connection by means of a channel, which is provided with a back valve. The channel connecting the cylinder cavities is made in the form of annulus between the compensative rod and the piston. A bush with external bevel positioned above the piston on the compensative rod, together with the piston butt end forms a groove. A groove is provided with a conduit running along the groove bottom, the conduit being in a fluid connection with the annulus formed between the piston and the compensative rod. An elastomer <<O>> ring is placed in the groove for preventing fluid from flowing in the opposite direction.

The disadvantage of this design is that when using a jar with BHA in drilling process there is a possibility of unauthorized (accidental) jar operation as result of normal axial operational loads, for example when a bit is being lifted off the bottom or in the course of tripping process. This situation is frequently observed in practice and often causes failure of BHA telescopic system electronic components due to impacts, and further may result in overloads of the pipe string with undesired dynamic forces.

One approach to solve the above described problem is providing a jar having a fixed bush. For example, in a jar described in patent RU 2230880, publ. Jan. 20, 2004 movable jar parts are fixed by means of a destructive bush. However, the above described technical solution provides connection of movable jar parts only once, before it is used for the first time. Later, after the dislodging, the jar needs to be pulled out to replace a destructive plug. Otherwise, in subsequent drilling operations after the dislodging operation the jar can be subjected to unauthorized accidental impacts that reduce the jar life time and may cause inconveniences when handling drill pipes.

Another drawback of the above described prior art jar constructions is that they do not allow to induce torque impacts in addition to axial impacts that significantly limits the possibilities of retrieving a stuck equipment.

RU 2291275, C2, E21B31/113, publ. Aug. 20, 2007, discloses a jar construction, wherein a splined connection of the body and spindle is made in the form of a helical curve that enables the jar to make both torsion and axial impacts. However, this technical solution does not prevent accidental unauthorized actuation of the jar mechanism in cases when rotation torques can occur in addition to axial loads, for example in rotary drilling, and overloads the pipe string with undesired dynamic forces.

Thus, there is an existing need to provide a jar with enhanced operation capabilities while reducing or avoiding the possibility of accidental unauthorized actuation of the jar mechanism.

BRIEF SUMMARY OF THE INVENTION

The object of the invention is therefore to provide a hydraulic jar where the disadvantages of the prior art can be avoided or at least ameliorated. Another object of the invention is to provide a hydraulic jar with enhanced functional capabilities and a means to prevent accidental jar actuation. Still another object is to provide a method for dislodging a stuck object in a wellbore using a hydraulic jar, in a way enabling to strike a stuck object by impacts selected from axial impacts, torque impacts, and a combination of torque impacts together with axial impacts, to dislodge the stuck body.

This and another problems that can be apparent from the foregoing description of the invention are solved by providing a hydraulic jar comprising a jar body and a spindle, which are connected by means of a movable splined connection (the so-called "splined pair") in the form of a helical curve to enable torque impacts. The jar body is adapted to be connectable to a pipe string and a stuck object, which is to be released.

In one embodiment of the invention, the jar body is rigidly fixed to a bottom sub.

In one embodiment of the invention, a cylinder is positioned within the jar body with a radial gap. The cylinder has chambers filled with work fluid, which are separated by a piston, and connected by a channel. In one embodiment of the invention, the cylinder is provided with elongated grooves on the inner cylinder surface, which interacts with the piston. In one embodiment of the invention, elongated grooves on the inner cylinder surface increase the effective diameter of the cylinder inner surface. In one embodiment of the invention, the piston is connected to tractive and compensative rods sealed with packers. The piston is further provided with split elastic compression rings, where initial gaps in the compression rings when piston is placed within cylinder are equal or close to zero. In one embodiment of the invention, the spindle is rigidly bound to the pipe string, for example by means of a collar or a nipple. In one embodiment of the invention, the spindle has a head for striking the jar body. In one embodiment of the invention, the tractive rod and the compensative rod are sealed with upper and bottom packers respectively.

In one embodiment of the invention, the channel for providing a fluid connection between the said cylinder chambers is made in the piston.

In another aspect of the invention, a method for dislodging a stuck object in a wellbore using the hydraulic jar is provided, comprising the steps of:

providing a hydraulic jar comprising a jar body, a spindle connectable to a pipe string and a stuck object to be released, the spindle being connected to the jar body by means of a helical splined coupling and axially movable within the jar body, a cylinder for filling with a work fluid and having a piston axially movable within the cylinder; positioning the jar adjacent the stuck object; charging the jar with a compressing load; stretching the pipe string to provide a stretching load, and maintaining the stretching load for a time period until the jar strikes the stuck body and dislodges it.

In one embodiment of the invention, the compressing load for effecting axial impacts is from 5 to 8 ton. In one embodiment of the invention, the stretching load for effecting axial impacts is from 5 to 10 ton.

In another embodiment of the invention, a method for dislodging a stuck object in a wellbore is provided, wherein the method comprises a step of charging the jar with compressing load; providing a required torque moment to the pipe string; a step of, while maintaining the torque moment, applying the stretching load to the pipe string, to provide the necessary stretching load to the jar until the jar strikes the stuck body and releases it. Preferably, in this embodiment, the torque moment for effecting torque impacts is from 500 to 800 kg per m.

In still another embodiment of the invention, a method for dislodging a stuck object in a wellbore is provided, wherein the method comprises: a step of applying a compression load to the jar, a step of providing a torque moment, while maintaining the compressing load, a step of stretching the pipe string to provide a stretching load, and maintaining the stretching load for a time period whereby the jar exerts torque impacts together with axial impacts to dislodge the stuck body. Preferably, according to this embodiment, the compression load of 3 to 4 tons is maintained. Preferably, according to this embodiment, the stretching load is from 10 to 30 ton is maintained. Preferably, in this embodiment, the torque moment is from 500 to 800 kg.m.

In still another embodiment of the invention, a method for dislodging a stuck object in a wellbore is provided, wherein the jar is charged with a compressing load and used to strike a stuck object by axial impacts, then, optionally, the jar is charged with a torque moment and used to strike the stuck object using torque impacts, and then, optionally, the jar is charged with both compressing load and torque moment to exert torque impacts together with axial impacts, to dislodge the stuck body. Preferably, according to this embodiment, after charging the jar with a compressing load, the load is maintained for a time period of 5 to 8 min or more and then the charging operation is repeated.

In still another embodiment, in case the stuck object is not released after the jar has exerted an impact as described in any of the above mentioned embodiments, charging of the jar is repeated using the compressing load increased to 20 to 25 tons.

Advantageously, according to the invention, a jar comprising a cylinder housed inside a jar body with a radial gap therebetween and provided with split compression rings having initial gaps which are equal or close to zero, provides the following technical benefits:

- movable jar parts are fixed when operational loads are applied to BHA;
- the jar can be operated only when necessary, i.e. when a tool is stuck in a wellbore and tensile loads and (or) rotation torques reach maximum calculated values.

Without being bound by a particular mechanism, the inventors believe that the jar according to the invention operates as follows. When a BHA is stuck, and/or when rotation torques or tensile loads acting upon the jar exceed operation values and reach maximum calculated values, the movable jar part will get a possibility of axial displacement, and in this way the jar starts releasing the stuck BHA tool.

Thus, the above described jar characterized by the features as indicated in Claim 1 provides the possibility both to fix the movable jar parts while BHA operates under normal operation conditions and to initiate the jar operation in case when BHA got stuck.

A further advantage of the jar according to the invention is that, once the stuck tool is released, and the loads acting upon the jar are decreased to operating levels, the jar movable parts will be fixed in the original position without the necessity to retrieve the jar to the surface.

As to the best knowledge to the inventors of the present invention, among available sources no one jar design is disclosed which is equivalent to the jar construction as claimed according to the present invention. For these reasons, in our opinion, the claimed jar may be considered as complying with the inventive step criterion of patentability.

BRIEF DESCRIPTION OF THE DRAWINGS

The present invention is further illustrated with reference to the following non-limiting example embodiments shown in the figures.

DETAILED DESCRIPTION OF THE INVENTION

Figure 1:
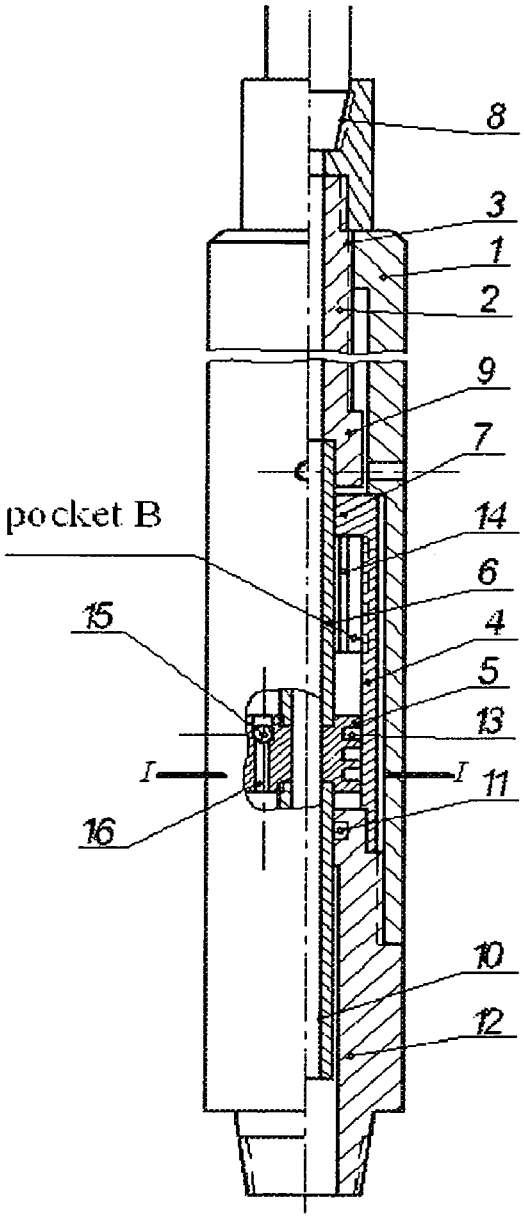
FIG. 1 illustrates longitudinal section of jar mechanism.

The present invention will be further described by way of one of non-limiting example embodiments as shown in FIG. 1.

In the figure, a jar according to one embodiment of the invention comprises jar body 1, in which a spindle 2 is placed with the ability of axial movement within jar body 1 by means of a splined connection 3 made in the form of a helical curve. Cylinder 4 is concentrically placed within jar body 1. Piston 5 adapted for axial movement within the cylinder 4 is connected to spindle 2 through tractive rod 6. Tractive rod 6 is sealed with upper packer 7 and joined to spindle 2, which is rigidly bound to the pipe string through collar 8, wherein spindle 2 has a head 9 for striking jar's body 1. Compensative rod 10, located below piston 5 is sealed with bottom packer 11 placed in bottom sub 12, which in turn is rigidly bound to the body 1. Elastic split compression rings 13 are mounted on the piston 5. Slot grooves 14 are made on internal surface of cylinder 4 along the part of its length, to increase the effective diameter of its inner surface. Piston 5 is provided with back valve 15. The jar body 1 and cylinder 4 are positioned with a gap $\delta'_{\mu}$ therebetween, joints of elastic compression rings 13 have initial gaps $\delta'_{K}$, initial gap between piston 5 and cylinder 4 is $\delta'_{n}$.

The jar device in one embodiment according to the invention operates as follows.

Figure 2:
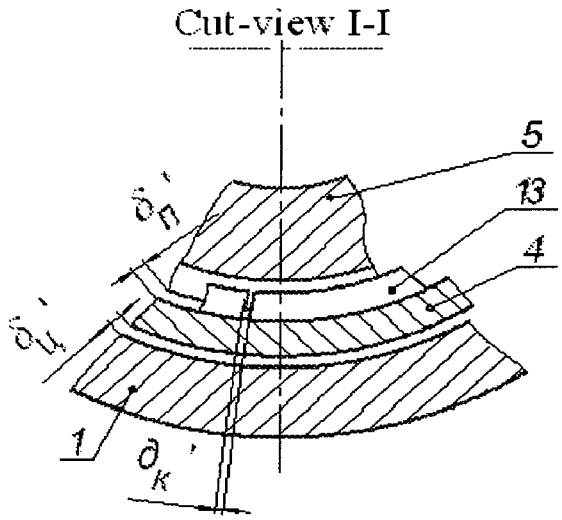
FIG. 2 is the cross section I-I of the jar when the jar movable parts are in fixed position while drilling.
Figure 3:
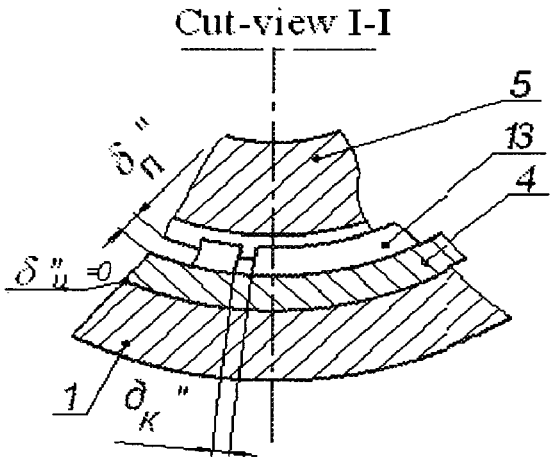
FIG. 3 is the cross section of the same place of the same parts in the process of decoupling for making impacts.

During jar operation in BHA, when operational loads do not exceed calculated values, a jar remains in a locked position. After having reached rotation torque and (or) axial load of maximum calculated values, spindle 2 begins to wriggle out of the body 1 in the helical splined pair for subsequent operation of the jar. Upon that, rods 6 and 9 together with piston 5 will begin to move upwards, resulting in pressure increase in cavity <<B>> of cylinder 4 above piston 5. Inner pressure, which rises in cylinder 4, leads to elastic expansion of cylinder 4 and subsequent increase of its inside and outside diameters to the value of the initial gap size $\delta'_{\mu}$ (FIG. 2) between cylinder 4 and body 1. In such position gap $\delta''_{\mu}$ (FIG. 3) becomes equal to zero and body 1 starts receiving part of inner pressure of cylinder 4 as well but due to bigger wall thickness of body 1 in comparison to wall thickness of cylinder 4, the extension of cylinder 4 is restricted preventing its destruction. However, elastic expansion of cylinder 4 before it touches the inner surface of body 1 leads to increase of gaps $\delta'_{K}$ in joints of elastic compressive rings 13. If at start up before loading the initial gaps in joints of elastic compressive rings were $\delta'_{K}$, then due to elastic expansion of cylinder 4 by value $\delta'_{\mu}$, gaps in joints of elastic compressive rings reach $\delta''_{K}=(\delta'_{K}+2\pi\delta'_{\mu})$.

However, the gap between piston 5 and cylinder 4 also increases up to $\delta''_{n}=(\delta'_{n}+\delta'_{\mu})$. As a result, after the above described elastic deformation of cylinder 4, gaps in joints of compressive rings 13 will have the following sizes:

in a radial direction $\delta''_{n}=(\delta'_{n}+\delta'_{\mu})$;

in a circumferential direction $\delta''_{K}=(\delta'_{K}+2\pi\delta'_{\mu})$.

That is under given calculated pressure drop in cavity <<B>> of cylinder 4, the inflow of work fluid between piston 5 and cylinder 4 increases rapidly.

With the initial gap $\delta'_{K}$ between gaps of elastic compression rings 12 equal to zero or close, we have an opportunity to fix moving jar parts. That is under short rotation torques and tensile loads, affecting piston 2, moving jar parts will almost remain still or their movement will be very slight. When the rotation torque and (or) tensile loads will reach significant values, for example, in case of BHA sticking, and the elastic extension of cylinder 4 will reach maximum value before the touching body 1, a disruption of moving jar parts from the fixed position will take place. Later, during movement of moving jar parts, piston 5 reaches grooves 14, as a result—pressure relief along piston—torque and axial impacts take place through head 9 of spindle 2 on body 1.

The above described small deformations of cylinder 4 and rings 13 occur within limits of elastic deformation, that's why after impact they have original sizes again. For this reason the jar becomes fixed again once the pressure is relieved and piston 5 returns down to its original position, when fluid influx through piston 5 occurs through back valve 15 and channel 16.

As it was mentioned above, further increase of decoupling load won't lead to sufficient increase of gap area in joints of compression rings due to elastic expansion of cylinder 4, as cylinder 4 rests upon inner surface of body 1, which has significant wall thickness. Significant wall thickness of body 1 is caused by the fact that torque and axial loads, generated by jar, go through the body and by-pass cylinder 4. Thus, in the suggested jar design, cylinder 4 receives only that pressure drop on piston 5, which is set for jar release.

Lead angle of helical splined pair will determine the degree of influence of axial or torque loading component on piston 5. Required lead angle of helical splined pair shall be given by particular requirements of field experience. For example, in rotary drilling, when sticking of downhole equipment involves steplike torque amplification on a pipe string, it is useful to have a small lead angle on helical surface of splines. In downhole drilling, when a pipe string experiences axial loads in a greater degree, the lead angle on helical surface of splines is useful to have it 45 degrees or more. It's obvious that by analogy with other hydraulic jars, it is easy to make the suggested jar for downward impacts in combination with torque impacts of right and left direction.

As is apparent from the above made preliminary calculations, for the most typical jar diameters applied in well drilling in BHA, a specialist in the art will easily select optimal gaps between jar body 1 and cylinder 4 as applied in general engineering, which would allow to implement the invention with the achievement of the above described preliminary fixation of movable jar parts.

The claimed jar allows to increase the effectiveness of BHA operation in well drilling, especially when BHA comprises a telescopic system, since exception of unauthorized accidental operations of a jar substantially reduces the risk of failure in telescopic system electronic components, make the drilling process more predictable and enhance endurance of a jar itself. In case of emergency, the probability of retrieving stuck assembly will be incomparably higher, since the claimed jar provides the possibility to make simultaneously axial and torque impacts.

EXAMPLE 1

A hydraulic jar as described in FIG. 1 was loaded using compressing load of 6 tons. After loading the jar, the load was maintained at that level and further, the torque moment of 700 kg. m was applied to the pipe string which was fixedly bound to the jar. While maintaining the torque moment, the pipe string was stretched with stretching load of around 5 to 8 ton until the jar stroke the stuck body and released it.

EXAMPLE 2

The jar was used as described above, with the difference in that, when the jar was charged with a compressing load and used to strike a stuck object by axial impacts, then, the jar was charged with a torque moment and used to strike the stuck object using torque impacts, and then, again, the jar was charged with both compressing load and torque moment to exert torque impacts together with axial impacts, to dislodge the stuck body.

Changes can be made in the combination and arrangement of the various parts and elements described herein without departing from the spirit and scope of the invention as defined in the following claims.

We claim:

1. A hydraulic jar comprising:

a jar body;

a spindle axially movable within the jar body and coupled to the jar body by means of a helical splined coupling; the spindle being connectable to a pipe string and the stuck object;

a cylinder concentrically placed within the jar body with a radial gap, and having chambers for filling with a work fluid, the chambers being separated by a piston and fluidly connected by a channel, wherein the channel is provided by a back valve;

wherein the piston is axially movable within the cylinder, and is connectable to the spindle by means of a tractive rod, and to the body by means of a compensative rod; the piston is further provided with elastic split compression rings having initial gaps equal or close to zero.

2. The hydraulic jar of claim 1, wherein the spindle is rigidly bound to the pipe string by means of a collar.

3. The hydraulic jar of claim 1, wherein the spindle has a head for striking the jar body.

4. The hydraulic jar of claim 1, wherein the tractive rod and the compensative rod are sealed with upper and bottom packers respectively.

5. The hydraulic jar of claim 1, wherein the jar body is rigidly connected to a bottom sub.

6. The hydraulic jar of claim 1, wherein the cylinder is provided along a part of the cylinder's length with longitudinal grooves made on the internal surface contacting the piston, for increasing the effective diameter of the cylinder's inner surface.

7. A method for dislodging a stuck object in a wellbore, comprising the steps of:

providing a hydraulic jar comprising a jar body, a spindle connectable to a pipe string and a stuck object to be released, the spindle being connected to the jar body by means of a helical splined coupling and axially movable within the jar body, a cylinder for filling with a work fluid and having a piston axially movable within the cylinder, the piston being further provided with elastic split compression rings having initial gaps equal or close to zero;

positioning the jar adjacent the stuck object;

charging the jar with a compressing load;

applying a torque moment to the jar;

stretching the pipe string to provide a stretching load, maintaining the stretching load for a time period until the jar strikes the stuck object and dislodges the stuck object.

8. The method for dislodging a stuck object in a wellbore of claim 7, further comprising, after a charging step, a step of maintaining the compressing load, a step of providing a torque moment, a step of maintaining the torque load, a step of stretching the pipe string to provide a stretching load, and maintaining the stretching load for a time period whereby the jar exerts torque impacts together with axial impacts to dislodge the stuck object.

* * * * *